US012318058B2

(12) United States Patent
Fazio et al.

(10) Patent No.: US 12,318,058 B2
(45) **Date of Patent: *Jun. 3, 2025**

(54) VACUUM NOZZLE SYSTEM

(71) Applicant: SONNY'S ENTERPRISES, LLC, Tamarac, FL (US)

(72) Inventors: Paul Fazio, Plantation, FL (US); Anthony Analetto, Weston, FL (US); David Guzman, Deerfield Beach, FL (US); Michael Doty, Coral Springs, FL (US)

(73) Assignee: Sonny's Enterprises, LLC, Tamarac, FL (US)

( * ) Notice: Subject to any disclaimer, the term of this patent is extended or adjusted under 35 U.S.C. 154(b) by 28 days.

This patent is subject to a terminal disclaimer.

(21) Appl. No.: 18/498,089

(22) Filed: Oct. 31, 2023

(65) Prior Publication Data

US 2024/0065500 A1 Feb. 29, 2024

Related U.S. Application Data

(63) Continuation of application No. 17/315,618, filed on May 10, 2021, now Pat. No. 11,882,983.

(51) Int. Cl.

| | |
|---|---|
| ***A47L 9/02*** | (2006.01) |
| ***A47L 5/38*** | (2006.01) |
| ***A47L 9/00*** | (2006.01) |

(52) U.S. Cl.

CPC ..... *A47L 9/02* (2013.01); *A47L 5/38* (2013.01); *A47L 9/0009* (2013.01)

(58) Field of Classification Search

CPC ..... A47L 9/02; A47L 9/009; A47L 9/0063; A47L 9/0027; A47L 9/0054; A47L 5/38

USPC ..... 15/246.2, 323, 420

See application file for complete search history.

(56) References Cited

U.S. PATENT DOCUMENTS

| | | | | |
|---|---|---|---|---|
| 1,519,868 A * | 12/1924 | Marshall | A47L 9/02 | |
| 2,068,496 A | 1/1937 | Linghammar | A47L 9/02 | 15/415.1 |
| 3,134,128 A | 5/1964 | Campbell | A45D 24/32 | 15/422 |
| 3,169,843 A | 2/1965 | Campbell | A45D 24/32 | 55/467 |

(Continued)

OTHER PUBLICATIONS

Fig. 1 YouTube video clip entitled "Carolina Pride Stainless Steel Vacuum Stanchions", uploaded on May 28, 2020 by user "Carolina Pride Carwash Systems & Solutions". Retrieved from Internet: <https://www.youtube.com/watch?v=ShHcBYpORAk> at 0:54 seconds. (Year: 2020).*

(Continued)

*Primary Examiner* — C. A. Rivera

(74) *Attorney, Agent, or Firm* — Laurence A. Greenberg; Werner H. Stemer; Ralph E. Locher

(57) ABSTRACT

A vacuum nozzle system has a vacuum nozzle with an inlet opening for engaging a surface to be vacuumed and an outlet opening for connection to a vacuum supply hose. The inlet opening is delimited by a circumferential end face. The nozzle defining a vacuum flow direction from the inlet opening to the outlet opening. A holder bracket has a holder for holding the nozzle. The holder is disposed downstream of the end face in a vacuum flow in the vacuum flow direction when the nozzle is in a retained position on the holder bracket.

13 Claims, 7 Drawing Sheets

(56) References Cited

U.S. PATENT DOCUMENTS

| | | | | |
|---|---|---|---|---|
| D215,875 | S | 11/1969 | Hoadley | D32/32 |
| 4,553,284 | A * | 11/1985 | Strumbos | A47L 9/02 |
| D309,205 | S | 7/1990 | Wilhelm | |
| D374,524 | S | 10/1996 | Harris | |
| D538,986 | S | 3/2007 | Ingram | A47L 9/02 D32/32 |
| D621,110 | S | 8/2010 | Eden | D32/32 |
| 7,945,990 | B2 | 5/2011 | Gabric | A47L 5/38 15/315 |
| D666,373 | S | 8/2012 | Eden et al. | |
| D725,858 | S | 3/2015 | Schultz et al. | |
| D809,887 | S | 2/2018 | Pentland | |
| D880,794 | S | 4/2020 | Doucette, Jr. et al. | |
| 2008/0092323 | A1 * | 4/2008 | Smith | A47L 9/244 15/314 |
| 2009/0188073 | A1 | 7/2009 | Gabric | A47L 9/0009 15/323 |
| 2010/0325831 | A1 | 12/2010 | Lee | A47L 9/0027 15/323 |
| 2011/0041282 | A1 | 2/2011 | Smith | A47L 9/0063 15/323 |
| 2012/0110770 | A1 | 5/2012 | Hirashima | A47L 9/02 15/246.2 |
| 2012/0311815 | A1 * | 12/2012 | Pickens | A47L 5/38 15/414 |
| 2013/0007979 | A1 | 1/2013 | Wolfe | A47L 9/0018 15/323 |
| 2013/0125329 | A1 * | 5/2013 | Shrum | A47L 9/02 15/246.2 |
| 2017/0325644 | A1 | 11/2017 | Muyters | |
| 2020/0178745 | A1 | 6/2020 | Nieschwitz | A47L 5/38 |

OTHER PUBLICATIONS

Fig. 2 YouTube video clip entitled "Carolina Pride Stainless Steel Vacuum Stanchions", uploaded on May 28, 2020 by user "Carolina Pride Carwash Systems & Solutions". Retrieved from Internet: <https://www.youtube.com/watch?v=ShHcBYpORAk > at 0:52 seconds. (Year: 2020).*

Fig. 3 YouTube video clip entitled "Carolina Pride Stainless Steel Vacuum Stanchions", uploaded on May 28, 2020 by user "Carolina Pride Carwash Systems & Solutions". Retrieved from Internet: <https://www.youtube.com/watch?v=ShHcBYpORAk > (zoom in on fig. 1). (Year: 2020).*

Fig. 4 YouTube video clip entitled "Carolina Pride Stainless Steel Vacuum Stanchions", uploaded on May 28, 2020 by user "Carolina Pride Carwash Systems & Solutions". Retrieved from Internet: <https://www.youtube.com/watch?v=ShHcBYpORAk > at 1:53 time. (Year: 2020).*

Fig. 5 YouTube video clip entitled "Carolina Pride Stainless Steel Vacuum Stanchions", uploaded on May 28, 2020 by user "Carolina Pride Carwash Systems & Solutions". Retrieved from Internet: <https://www.youtube.com/watch?v=ShHcBYPORAk > at 1:17 time. (Year: 2020).*

Sonny's: "Vacuum Express Claw w/Bracket & Holster", Material ID:20010296, Retrieved from: https://www.sonnysdirect.com/sonnysdirect/en/Parts-Supplies/Vacuum-Parts/Vacuum-Express-Claw-w-Bracket-Holster/o/000000000020010296, 2007.

Fig. 1 YouTube video clip entitled "Carolina Pride Stainless Steel Vacuum Stanchions", uploaded on May 28, 2020 by user "Carolina Pride Carwash Systems & Solutions". Retrieved from Internet: <https://www.youtube.com/watch?v=ShHcBYpORAk > (Year: 2020).

Fig. 2 YouTube video clip entitled "Carolina Pride Stainless Steel Vacuum Stanchions", uploaded on May 28, 2020 by user "Carolina Pride Carwash Systems & Solutions". Retrieved from Internet: <https://www.youtube.com/watch?v=ShHcBYpORAk > (Year: 2020).

Fig. 3 YouTube video clip entitled "Carolina Pride Stainless Steel Vacuum Stanchions", uploaded on May 28, 2020 by user "Carolina Pride Carwash Systems & Solutions". Retrieved from Internet: <https://www.youtube.com/watch?v=ShHcBYpORAk > (Year: 2020).

Fig. 4 YouTube video clip entitled "Carolina Pride Stainless Steel Vacuum Stanchions", uploaded on May 28, 2020 by user "Carolina Pride Carwash Systems & Solutions". Retrieved from Internet: <https://www.youtube.com/watch?v=ShHcBYpORAk > (Year: 2020).

Fig. 5 YouTube video clip entitled "Carolina Pride Stainless Steel Vacuum Stanchions", uploaded on May 28, 2020 by user "Carolina Pride Carwash Systems & Solutions". Retrieved from Internet: <https://www.youtube.com/watch?v=ShHcBYPORAk > (Year: 2020).

* cited by examiner

VACUUM NOZZLE SYSTEM

CROSS-REFERENCE TO RELATED APPLICATION

This application is a continuation of patent application Ser. No. 17/315,618, filed May 10, 2021, the prior application is herewith incorporated by reference in its entirety.

FIELD AND BACKGROUND OF THE INVENTION

The invention relates, generally, to a vacuum nozzle system for a central vacuum system.

Vacuum claws or suction nozzles are used in central vacuum systems in cleaning installations for vehicles to allow multiple individuals to simultaneously use respective claws to vacuum vehicles. When not in use, the claws or nozzles are placed on respective holder brackets. The central vacuum systems provide a continuous vacuum through the plumbing system so that the claws can be used simultaneously at any time. The claws are each connected to the vacuum by respective flexible/bendable hoses.

DESCRIPTION OF THE RELATED ART

As shown in FIGS. 1 and 2, designated as Prior Art, Sonny's prior claw discloses a claw and holster system 200 (Sonny's Vacuum Express Claw w/Bracket and Holster). The claw 201 has two openings: one is the entrance or inlet opening A where objects are vacuumed and the other is an exit opening B where a vacuum hose attaches and vacuumed objects exit the claw 201 into the hose (not shown). The claw initially 201 grows in cross-sectional area and then reduces in steps as it goes from entrance to exit. This growth and subsequent reduction of cross-sectional area leads to inconsistent air velocity. Particularly, as the claw 201 wears; the wear changes how the vacuum claw 201 operates throughout its lifecycle. The Sonny's nozzle has vertical stiffeners near the entrance opening A that result in a blockage point that may block larger objects from going through the claw, which could possibly damage equipment and which provide for structural support of the claw 201. The blockage point can also become a trap point for smaller objects that should be able to pass through and will cause the claw 201 to get clogged. When stored inside the holster 202, it is placed within an opening 203 that is provided in the holster 202. This construction means that the holster 202 engages the claw 201 upstream of the entrance opening A, in relation to an air flow path resulting from vacuum applied at the exit opening B, this in turn allows air leakage to create a "whistling" sound effect, which becomes more pronounced as the end face of the claw 201 becomes worn and marred or abraded during use of the claw 201 and the gaps between the holster 202 and the claw 201 increase. Furthermore, the gaps draw part of the suction power of the central vacuum system when the nozzles are stored, which in turn reduces vacuum performance on remaining nozzles of the system that are in use by users.

SUMMARY OF THE INVENTION

It is accordingly an object of the invention to provide a vacuum nozzle system that overcomes the herein-mentioned disadvantages of the heretofore-known devices of this general type, which are able to provide reliable suction and storage without undesirable noise pollution or reduction of vacuum in other nozzles of the central vacuum system.

With the foregoing and other objects in view there is provided, in accordance with the invention, a vacuum nozzle system that has a vacuum nozzle with an inlet opening and an outlet opening for connection to a vacuum supply hose. The inlet opening is delimited by a circumferential end face that engages a surface to be vacuumed. The nozzle defining a vacuum flow direction from the inlet opening to the outlet opening. A holder bracket has a holder for holding the nozzle. The holder is disposed downstream of the end face in a vacuum flow in the vacuum flow direction when the nozzle is in a retained position on the holder bracket.

In accordance with another feature of the invention, the nozzle has an inner wall defining a nozzle surface profile. The holder is constructed as a tongue with a circumferential tongue surface profile that matches the nozzle surface profile to seal the nozzle to the tongue when the nozzle is in the retained position.

In accordance with another feature of the invention, the nozzle surface profile is smooth and free of any protrusions.

In accordance with another feature of the invention, the end surface is provided with notches therein for allowing a bypass of vacuum between the nozzle and a surface to be vacuumed.

In accordance with another feature of the invention, the nozzle has a curved section in a longitudinal direction of the nozzle. The curved section has a structural rib on an external surface of the nozzle. The rib extends longitudinally on the nozzle.

In accordance with another feature of the invention, the structural rib is multiple ribs disposed on an inside and an outside of a curve of the curved section.

Other characteristic features of the invention are set forth in the appended claims.

Although the invention is illustrated and described herein as embodied in a vacuum nozzle system, it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of specific embodiments when read in connection with the accompanying drawings.

DETAILED DESCRIPTION OF THE INVENTION

Figure 1:
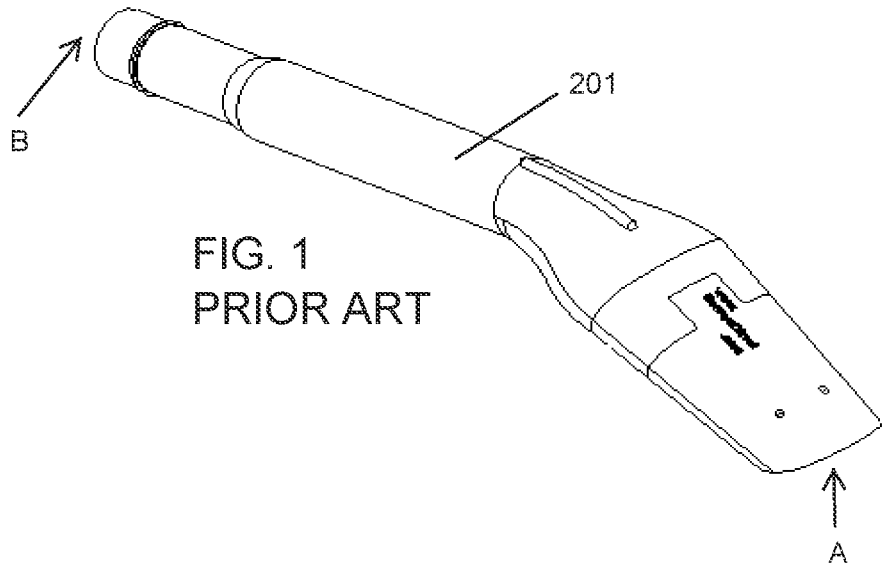
FIG. 1 PRIOR ART
FIG. 1 is a perspective view of a claw according to the Prior Art.
Figure 2:
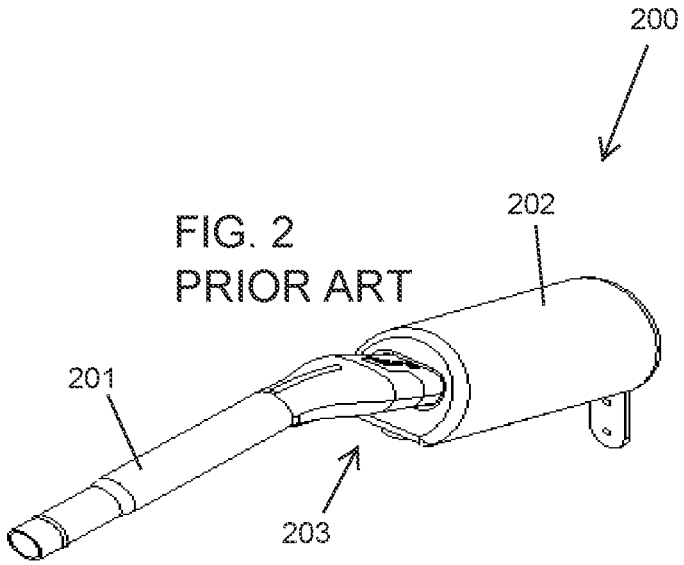
FIG. 2 PRIOR ART
FIG. 2 is a perspective view of the claw of FIG. 1 and a holder according to the Prior Art.
Figure 4:
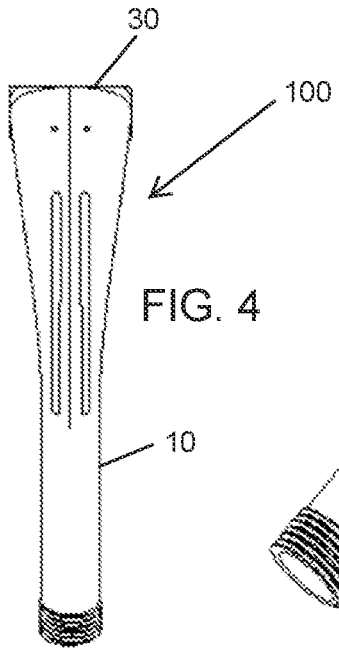
FIG. 4 is a top view of the vacuum claw system.

In all the figures of the drawing, sub-features and integral parts that correspond to one another bear the same reference symbol in each case.

Referring now to the figures of the drawings in detail and first, particularly, to FIGS. 3-10, there is shown a vacuum claw or nozzle 10 for a vacuum claw system 100. The vacuum claw 10 has an inlet opening 11 and an exit opening 12 for connection to a vacuum hose that is connected to a central vacuum system. The inlet opening 11 has a circumferential end surface 15 that is an end of the claw 10 and delimits the inlet opening 11. The claw 10 has a curved portion 13 that extends along a longitudinal direction of the claw 10 from the inlet opening end of the claw 10 when viewed from the side. The claw 11 is provided with external ribs 14 extending along the curved portion 13. The external ribs 14 are provided on the inside and outside of the curve of the curve portion 13. The provision of the external ribs 14 eliminates the need for internal stiffeners in the flow channel and results in a smoother transition of vacuumed objects passing through the claw 10.

Figure 3:
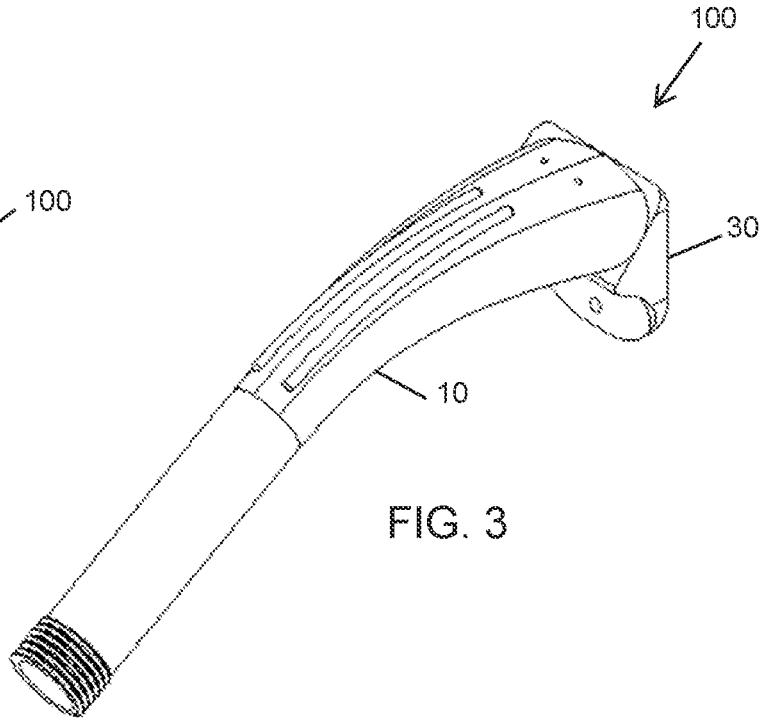
FIG. 3 is a perspective view of an embodiment of the vacuum claw system.
Figure 5:
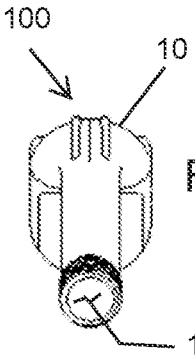
FIG. 5 is an end view of the vacuum claw system.
Figure 6:
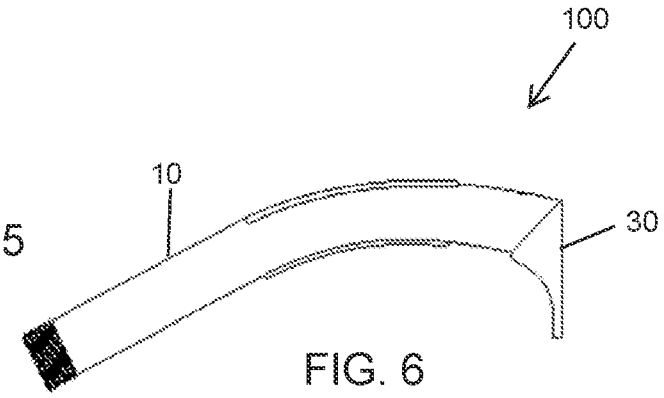
FIG. 6 is a side view of the vacuum claw system.
Figure 7A:
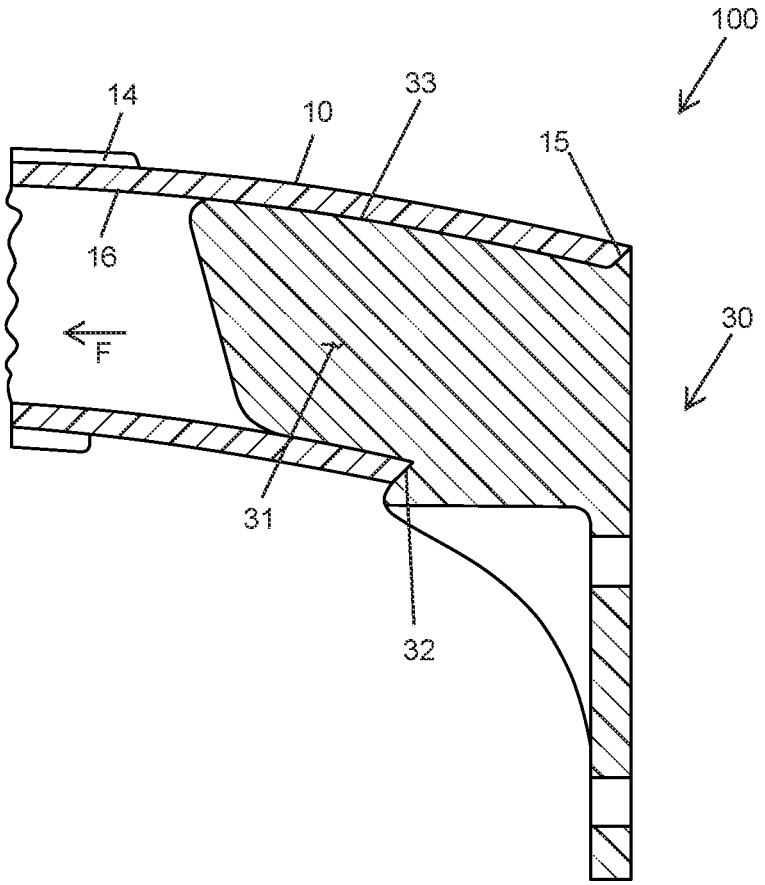
FIG. 7A is a section view of the vacuum claw system of FIG. 3 at the holder/claw interface.
Figure 7B:
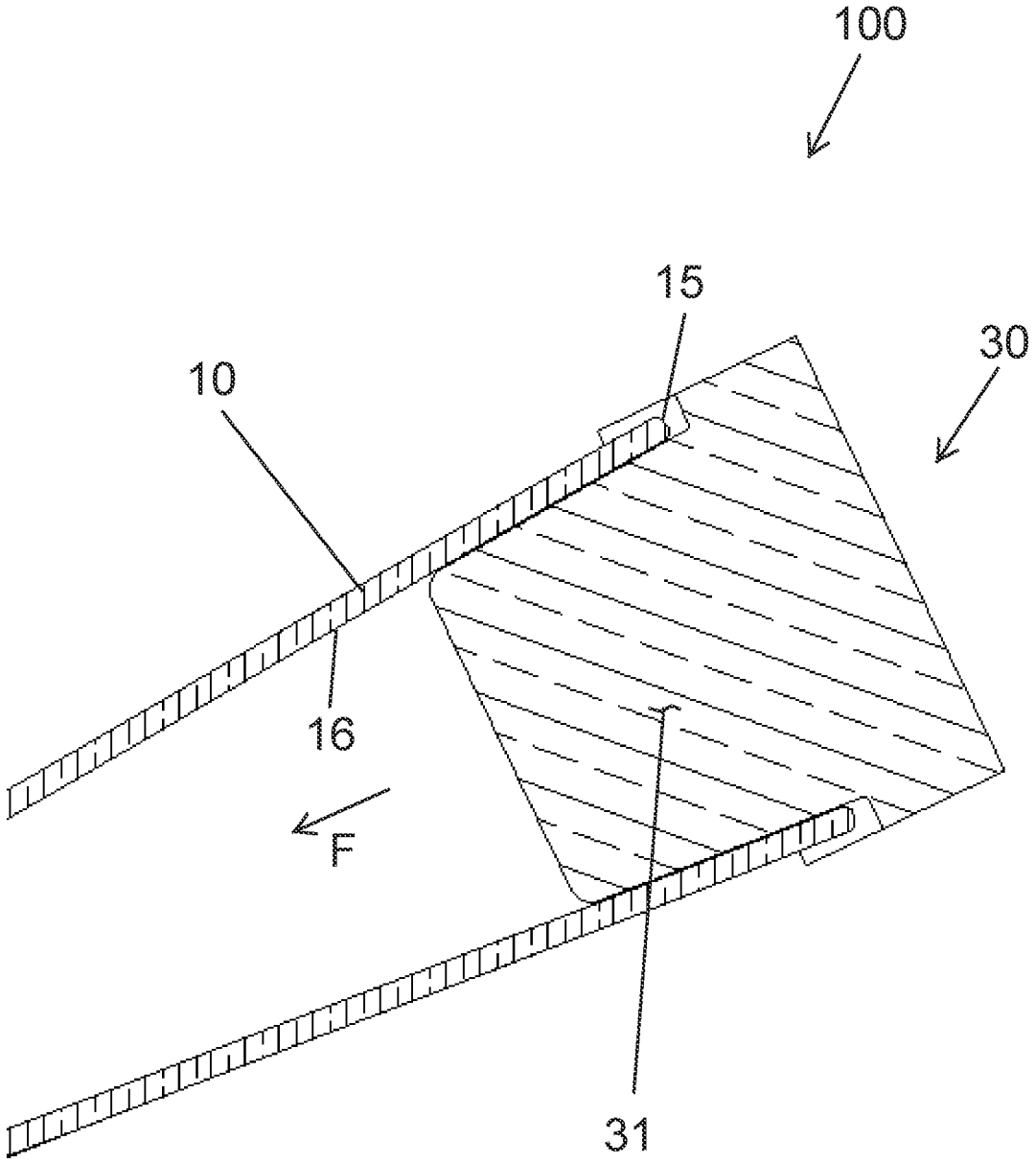
FIG. 7B is a section view of the vacuum claw system of FIG. 3 at the holder/claw interface.
Figure 8:
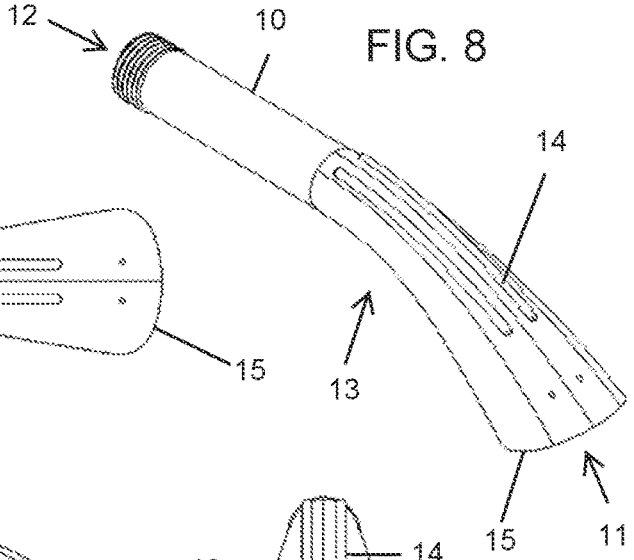
FIG. 8 is a perspective view of the claw of FIG. 3.
Figure 9:
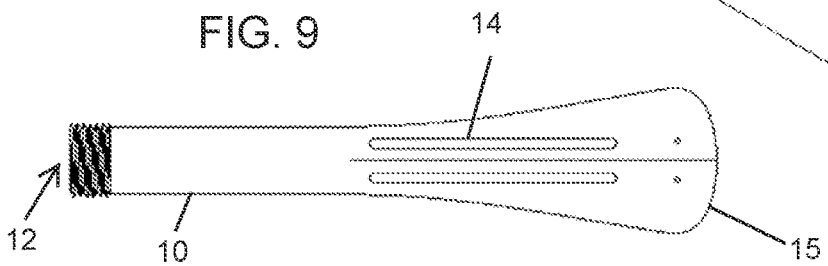
FIG. 9 is a top view of the claw.
Figure 11:
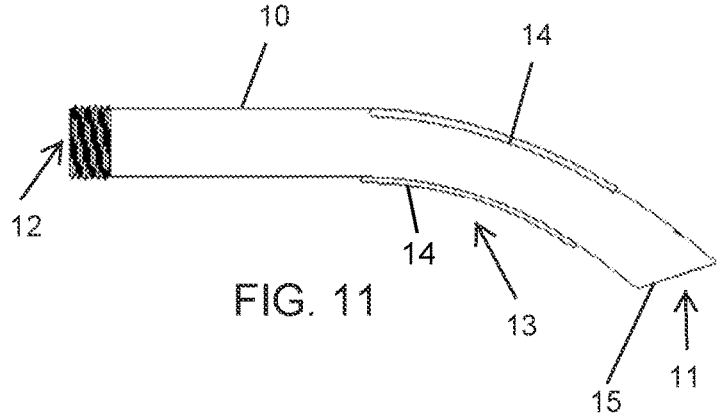
FIG. 11 is a side view of the claw.
Figure 10:
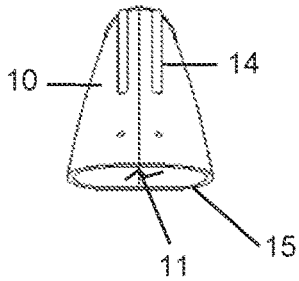
FIG. 10 is an end view of the claw.
Figure 14:
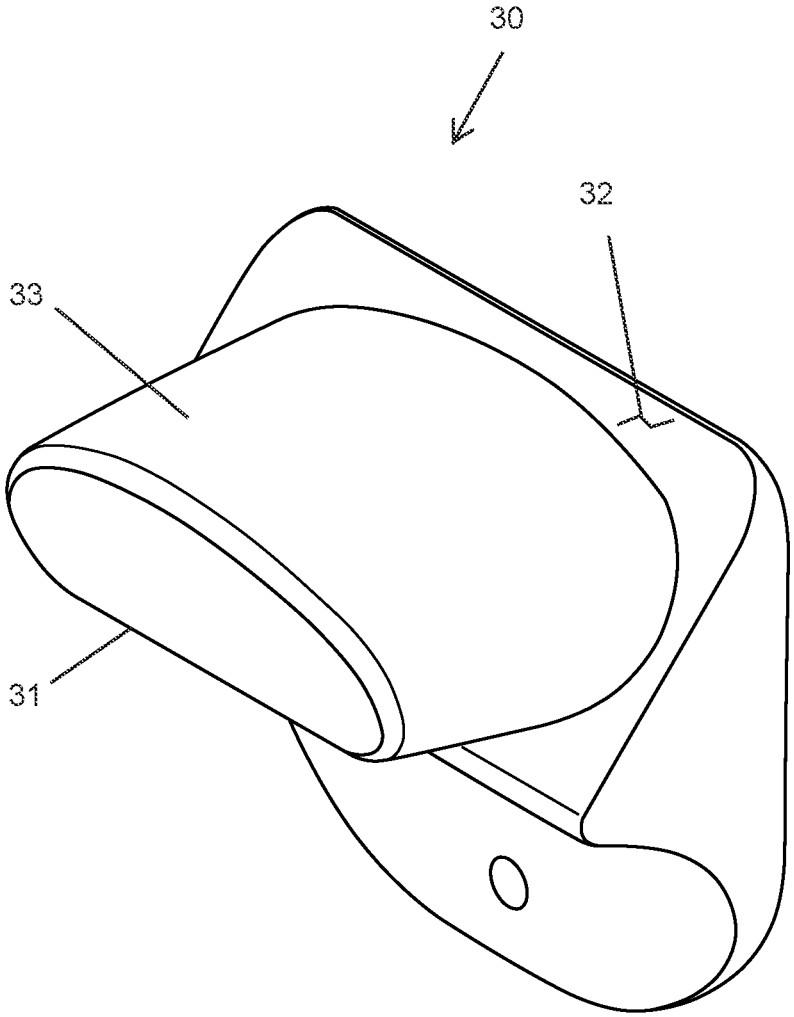
FIG. 14 is a perspective view of the holder bracket.

As shown best in FIGS. 3 and 14, the vacuum claw system 100 has a holder bracket 30 constructed for mounting to a substrate structure, the holder bracket 30 retains the claw 10 when not in use. In a claw retained position on the holder bracket 30, the holder bracket 30 has a holder 31 that is disposed within the claw 10 downstream of the end surface 15, with respect to an airflow direction F through the claw 10 resulting from vacuum applied at the exit opening. That is the flow begins at the inlet opening 11 and moves to the exit opening 12 where the exit opening 12 is downstream of the inlet opening 11 in regard to the flow direction. The holder 31 is defined by a tongue 31 that is received inside the claw 10 at the inlet opening 11. The tongue 31 has a circumferential surface profile 33 that matches the surface profile of an inner wall 16 (FIG. 7) of the claw 10 inside the claw 10 downstream of the end surface 15 so that the outer circumference of the tongue 31 seals against the inner wall 16. The circumferential surface profile 33 of the tongue 31 has a taper or draft angle in a longitudinal direction thereof (size reduces in the flow direction). The surface profile of the inner wall 16 has a corresponding (same) taper or draft angle in the longitudinal direction. The matching tapers of these surfaces ensures a reliable seal inside the nozzle 10 between the nozzle 10 and the tongue 31 even as the end surface 15 wears dramatically (up to an inch). As such, relationship accommodates wear of the end surface 15 of the claw 10 without a negative effect on the sealing between the tongue 31 and the claw 10. This results in not adding noise pollution from the nozzle and not adding load on the vacuum system from losses and maintains suction power in other nozzles of the central vacuum system that are in use.

The base of the tongue 31 may be provided with a shoulder 32 that has a height relative to the tongue 31 that matches the depth of the end face 15 along the insertion direction of the claw onto the holder, also referred to herein as the "depth" at the position of the shoulder 32 about the circumference of the end face 15. Particularly, as seen in the cross section of FIG. 7, the height is more prominent (prouder) at a side of the claw that is on the inside of the curve than on a side of the claw that is on the outside of the curve to correspond to the depth at the corresponding location.

Figure 12:
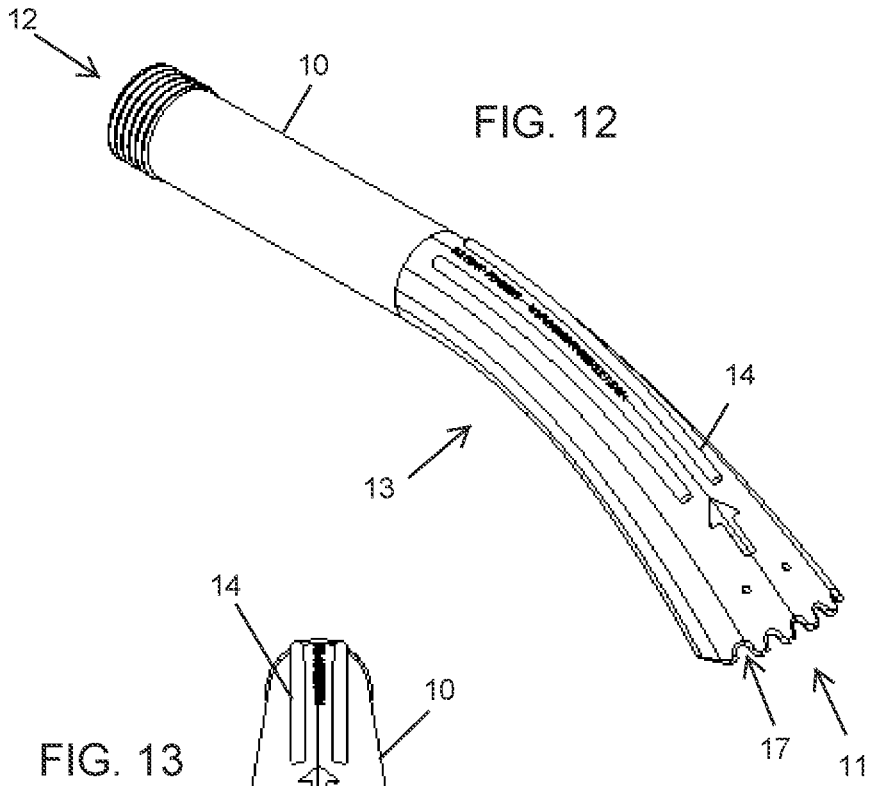
FIG. 12 is a perspective view of another embodiment of the claw.
Figure 13:
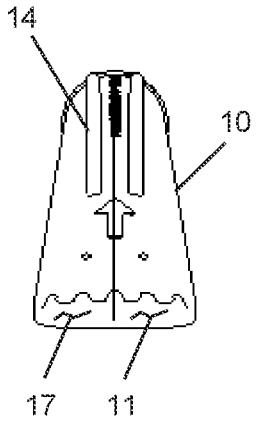
FIG. 13 is an end view of the claw of FIG. 12.

Applicant found that the implementation of the tongue 31 inserted into the claw 10 and engaging the inner wall 16 has several benefits. Firstly, the suction of the vacuum through the claw 10 provides for the claw 10 to seal onto the tongue 31, as the tongue 31 has a mating taper to the inner surface 16 of the inlet end of the claw 10, which closes off escaping air flow and thus solves the problem, associated with continuously running central vacuum systems, of whistling noise pollution common in existing claw holder brackets. Furthermore, the fact that the tongue 31 engages the inner wall 16 of the claw 10 allows for the claw 10 to have a notched or stepped circumferential end surface 15, as shown in FIGS. 12 and 13 and allows for the claw 10 to wear at the end surface 15 without change to the performance of the claw system 100. In particular, the sealing occurs inside the claw 10, downstream of the end surface 15. As such, the system can accommodate any abrasions, uneven wear or damage to the end surface 15 during regular use of the nozzle 10 over its lifetime. In other words, contrary to a holster type holder, the profile or smoothness of the end surface 15 does not have a detrimental effect on the system. Furthermore, the tongue 31 also provides for the claw 10 to be securely held by the holder bracket 30 even when the vacuum is turned off. It is pointed out that the end surface 15 is the face of the claw 10 that engages against the object/surface to be vacuumed. The notched end surface 15 provides gaps for an air flow to pass into the claw 10 between the claw 10 and the surface that is being vacuumed and prevents the claw 10 from sucking down onto the object being vacuumed, as is common problem in traditional claws. This air flow bypass provides the benefit of the claw 10 not getting stuck on the object vacuumed and thus is easier to advance along the surface of the object being vacuumed. This is especially beneficial when vacuuming flexible material such as fabrics, carpets, or seating surfaces of natural or synthetic materials. The notched or stepped end surface 15 can be provided as spaced notches 17 in the end surface 15 around the circumference of the inlet opening 11.

The invention claimed is:

1. A vacuum nozzle system, comprising:

a vacuum nozzle having an inlet opening and an outlet opening for connection to a vacuum supply hose, said inlet opening being delimited by a circumferential end face, said end face for engaging a surface to be vacuumed, said nozzle defining a vacuum flow direction from said inlet opening to said outlet opening; and a holder bracket having a holder for holding said nozzle, said holder sealing against an inside of said nozzle downstream of said end face in a vacuum flow in the vacuum flow direction when said nozzle is in a retained position on said holder bracket.

2. The vacuum nozzle system according to claim 1, wherein said nozzle has an inner wall defining a nozzle surface profile, said holder is constructed as a tongue with a circumferential tongue surface profile that matches said nozzle surface profile to seal said nozzle to said tongue when said nozzle is in the retained position.

3. The vacuum nozzle system according to claim 2, wherein said nozzle surface profile is smooth and free of any protrusions.

4. The vacuum nozzle system according to claim 2, wherein said holder bracket has a mounting flange at a base of said tongue.

5. The vacuum nozzle system according to claim 1, wherein said end surface is provided with notches therein for allowing a bypass of vacuum between the nozzle and a surface to be vacuumed.

6. The vacuum nozzle system according to claim 1, wherein said nozzle has a curved section in a longitudinal direction of said nozzle, said curved section has a structural rib on an external surface of said nozzle, said rib extends longitudinally on said nozzle.

7. The vacuum nozzle system according to claim 6, wherein said structural rib is multiple ribs disposed on an inside and an outside of a curve of the curved section.

8. The vacuum nozzle system according to claim 1, wherein said holder bracket has a mounting flange at a base of said holder.

9. A vacuum nozzle system, comprising:

a vacuum nozzle having an inner circumferential wall surface, an inlet opening and an outlet opening for connection to a vacuum supply hose, said inlet opening being delimited by a circumferential end face, said end face for engaging a surface to be vacuumed, said nozzle defining a vacuum flow direction from said inlet opening to said outlet opening; and a holder bracket having a tongue for holding said nozzle, said tongue projecting inside said nozzle downstream of said end face in a vacuum flow in the vacuum flow direction when said nozzle is in a retained position on said holder bracket, said tongue sealing against said inner circumferential wall surface and ensuring a reliable seal of the nozzle to the tongue, as said nozzle wears over a service life thereof.

10. A vacuum nozzle system, comprising:

a vacuum nozzle having an inner circumferential wall surface, an inlet opening and an outlet opening for connection to a vacuum supply hose, said inlet opening being delimited by a circumferential end face, said end face for engaging a surface to be vacuumed, said nozzle defining a vacuum flow direction from said inlet opening to said outlet opening; and a holder bracket having a tongue for holding said nozzle, said tongue projecting inside said nozzle downstream of said end face in a vacuum flow in the vacuum flow direction when said nozzle is in a retained position on said holder bracket, said tongue sealing against said inner circumferential wall surface and ensuring a reliable seal of the nozzle to the tongue, as said nozzle wears over a service life thereof;

said inner circumferential wall surface and said tongue having a same taper in a longitudinal direction of said nozzle and said tongue.

11. The vacuum nozzle system according to claim 9, wherein said tongue is constructed to securely hold said nozzle with the vacuum flow turned off.

12. A vacuum nozzle system, comprising:

a vacuum nozzle having an inlet opening and an outlet opening for connection to a vacuum supply hose, said inlet opening being delimited by a circumferential end face, said end face for engaging a surface to be vacuumed, said nozzle defining a vacuum flow direction from said inlet opening to said outlet opening; and a holder bracket having a holder for holding said nozzle, said holder being disposed inside said nozzle downstream of said end face in a vacuum flow in the vacuum flow direction when said nozzle is in a retained position on said holder bracket, said holder being constructed as a tongue, said tongue being constructed to securely hold said nozzle with the vacuum flow turned off.

13. The vacuum nozzle system according to claim 1, wherein said nozzle has an inner circumferential surface, said holder seals against said inner circumferential surface.

* * * * *